United States Patent [19]

Ikuta

[11] Patent Number: 4,845,407

[45] Date of Patent: Jul. 4, 1989

[54] FRONT EMISSION TYPE FLUORESCENT DISPLAY DEVICE

[75] Inventor: Yoichi Ikuta, Mobara, Japan

[73] Assignee: Futaba Denshi Kogyo K.K., Mobara, Japan

[21] Appl. No.: 212,021

[22] Filed: Jun. 23, 1988

Related U.S. Application Data

[63] Continuation of Ser. No. 903,423, Sep. 4, 1986, abandoned.

[30] Foreign Application Priority Data

Sep. 10, 1985 [JP] Japan ..... 60-198491

[51] Int. Cl.[4] ..... H01J 63/04

[52] U.S. Cl. ..... 315/169; 313/497; 358/252

[58] Field of Search ..... 313/496, 497, 467, 473; 315/169.3; 358/252

[56] References Cited

U.S. PATENT DOCUMENTS 4,472,658 9/1984 · Morimoto et al. ..... 313/497

FOREIGN PATENT DOCUMENTS 5346697 4/1978 Japan .

*Primary Examiner*—David K. Moore
*Assistant Examiner*—Theodore Salindong
*Attorney, Agent, or Firm*—Oblon, Spivak, McClelland, Maier & Neustadt

[57] ABSTRACT

A front.emission type fluorescent display device is disclosed which is capable of exhibiting an antireflection effect sufficient to ensure excellent visibility of the display section even under high illuminance and being manufactured with ease. The device includes an antireflection film arranged between a glass substrate and anode conductors. The antireflection film comprises a dielectric layer and an absorption metal layer selected so as to provide a combination in refractive index therebetween which is sufficient to minimize a reflectance at an interface between both layers.

4 Claims, 3 Drawing Sheets

FRONT EMISSION TYPE FLUORESCENT DISPLAY DEVICE

This application is a Continuation of application Ser. No. 903,423, filed on Sept. 4, 1986, now abandoned.

BACKGROUND OF THE INVENTION

1. Field of the Invention

This invention relates to a front emission type fluorescent display device. The front emission type fluorescent display device comprises an anode conductor formed of a metal film deposited on one surface of a glass substrate and a phosphor layer deposited on the anode conductor and is adapted to permit light emitted from the phosphor layer due to impingement of electrons thereon to be observed through the glass substrate and anode conductor from the other surface side of the glass substrate.

2. Description of the Prior Art

In a front emission type fluorescent display device, wiring conductors including anode terminals (hereinafter referred to as "wiring conductors") and anode conductors are formed by subjecting a film of a conductive material deposited on a substrate by means of sputtering, vapor deposition or the like to etching by photolithography to form a desired pattern. Accordingly, the wiring conductors and anode conductors are both formed of the same conductive material.

Such a conductive film for use in a flourescent display device is generally divided into a transparent conductive film such as an ITO film, a nesa film or the like and a metal film such as an aluminum film. When anode conductors are formed of the metal film, at least a part of the anode conductors is constructed to include a conductive section formed into a mesh-like or pectinate shape and gaps therebetween so that the anode conductors may be of light-permeability. This makes it possible to observe luminous display of phosphor layers deposited on the light-permeable anode conductors hereinafter referred to as "anode conductors") through the substrate and the anode conductors.

When the substrate of the front emission type fluorescent display device in which the wiring conductors and anode conductors are formed of the metal film is viewed from a display side, the wiring conductors and mesh-like anode conductors are observed as a specular surface on the opposite side of a transparent substrate. This causes incident light to be reflected on the specular surface at a positive reflectance of 80% or more, to thereby deteriorate visibility of a display section, particularly, under high illuminance.

In order to avoid such a problem, applicant has proposed in Japanese application No. 58-222714 filed Nov. 26, 1983 a front emission type fluorescent display device having a colored antireflection film interposed between wiring conductors and anode conductors each formed of a metal film and a substrate as shown in FIG. 3.

In FIG. 3, reference numeral 1 designates a glass substrate. The glass substrate 1 has an antireflection film 2 of a light-permeable material of low permeability, such as, for example, molybdenum oxide deposited on one surface thereof. On the antireflection film 2 is arranged a metal film 3 forming wiring conductors and anode conductors.

External light, for example, incident light 4 introduced from a light source 4*a* to the substrate 1 is partially reflected on an upper surface of the antireflection film 2. The remaining of the light is introduced into the antireflection film 2 and then reflected on an interface between the antireflection film 2 and the metal film 3 and passes through the antireflection film 2 and substrate 1 to the exterior, during which a part of the light is reflected on an upper surface of the substrate 1 and returned into the substrate.

In this manner, the external light is reflected on the substrate 1 and antireflection film 2 several times. In the course of the reflection, it is absorbed and diffused, which makes positive reflectance decrease and the specular surface of the metal film 3 hard to observe. In FIG. 3, the antireflection film 2 may be formed of a material having a low reflectance such as chromium oxide.

However, materials used for the antireflection film 2 are generally apt to lack stability. For example, chromium oxide and molybdenum oxide are both oxides of a transition metal element, which is reduced during a calcination step in the manufacturing of a fluorescent display device and deteriorate desired antireflection property. Also, the fluorescent display device described above has another disadvantage of failing to exhibit a sufficient antireflection effect, because the antireflection depends on only the absorption and diffusion of external light by the antireflection film.

SUMMARY OF THE INVENTION

The present invention has been made in view of the foregoing disadvantages of the prior art.

Accordingly, it is an object of the present invention to provide a front emission type fluorescent display device which is easy to manufacture and is capable of exhibiting an antireflection effect sufficient to provide a display section with satisfied visibility even under high illuminance.

It is another object of the present invention to provide a front emission type fluorescent display device which is capable of improving a light reflectance of a glass substrate to improve visibility of a display section.

In accordance with the present invention, a front emission type fluorescent display device is provided which includes a glass substrate, an antireflection film comprising a dielectric layer deposited on one surface of the glass substrate and an absorption metal layer deposited on the dielectric layer, and anode conductors formed of a metal film and arranged through the antireflection film.

In the front emission type fluorescent display device of the present invention, a part of external light incident to the glass substrate is reflected on an interface between the dielectric layer and the absorption metal layer and directed to the outside of the substrate. In this instance, the reflectance is determined depending on refractive indices of materials for the dielectric layer and absorption metal layer. Accordingly, a suitable combination of both materials makes it possible to decrease the reflectance to a low level.

Also, the determination of a thickness of the dielectric layer within a suitable range causes the reflected light and light reflected on an interface between the glass substrate and the dielectric layer to interfere with each other to weaken each other so that the reflectance of external light incident to the galss substrate may be further decreased. In the present invention, a part of the external light which reached the absorption metal layer through the glass substrate and dielectric layer is attenuated in the absorption metal layer and kept from reaching to an interface between the metal film forming anode conductors and the absorption metal layer.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, wherein.

DETAILED DESCRIPTION OF THE PREFERRED EMBODIMENTS

A front emission type fluorescent display device according to the present invention will now be described hereinafter with reference to the drawings.

Figure 2:
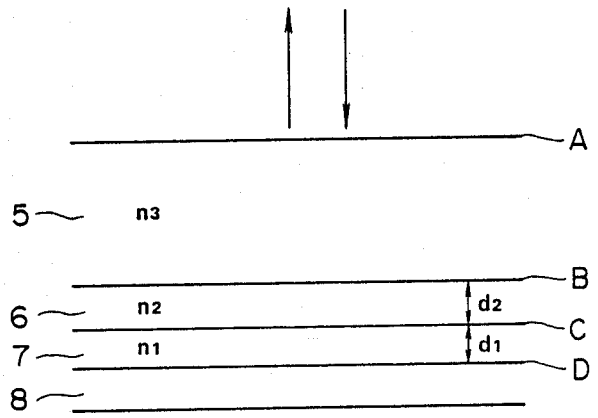
FIG. 2 is a diagrammatic view showing a principle of the present invention.
Figure 3:
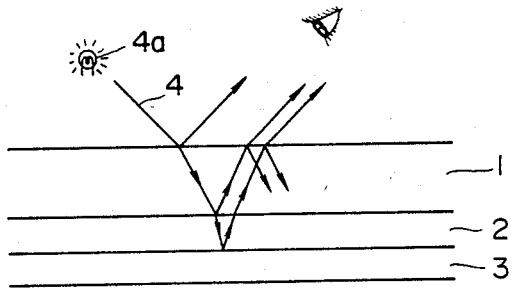
FIG.3 PRIOR ART
FIG. 3 is a diagrammatic view showing the refraction of external light on an antireflection film.

First, the essentials of an embodiment of the present invention will be described with reference to FIG. 2.

An antireflection film incorporated in a fluorescent display device of the present invention comprises a dielectric layer 6 deposited on one surface of a glass substrate 5 and an absorption metal layer 7 laminatedly deposited on the dielectric layer 6. On the absorption metal layer 7 is deposited a metal film 8 made of aluminum or the like to form anode and wiring conductors.

Materials for the dielectric layer 6 and absorption metal layer 7 are selected so that a reflectance R of external light at an interface C between both layers 6 and 7 may be close to zero.

The reflectance R is generally represented by the following equation:

$$R = \left| \frac{n_1 - n_2}{n_1 + n_2} \right|^2 \quad (1)$$

wherein, $n_1$ is a refractive index of a dielectric material and $n_2$ is a refractive index of an absorption metal material.

In light of the above equation, there are a number of combinations between refractive indices $n_1$ and $n_2$ which causes the reflectance R at the interface C to be zero or approach thereto. However, as a matter of fact, it is convenient to use the dielectric material having a refractive index $n_2$ of 1.0–3.5. The absorption metal is selected according to the equation (1) depending on the selected dielectric material.

A thickness $d_2$ of the dielectric layer is determined to satisfy conditions for causing light reflected on the interface C and light reflected at an interface B between the glass substrate 5 and the dielectric layer 6 to interfere with each other thereby to weaken each other.

Generally, a refractive index $n_3$ of the glass substrate 5 is low as compared with the refractive index $n_2$ of the dielectric material, and a phase of light reflected on the interface B is shifted by half-wave length $\lambda/2$. In this instance, when the refractive index $n_2$ of the dielectric material is smaller than the refractive index $n_1$ of the absorption metal, a phase of light reflected on the interface C likewise is shifted by half-wavelength $\lambda/2$. Accordingly, when the thickness $d_2$ of the dielectric layer 6 is determined to satisfy an equation of $nd=\lambda/4$, this causes lights reflected on both interfaces B and C to weaken each other due to an interference therebetween.

On the contrary, when the refractive index $n_2$ of the dielectric material is larger than that $n_1$ of the absorption metal, there is no phase shift of light reflected on the interface C. Accordingly, the determination of the thickness $d_2$ of the dielectric layer 6 which satisfies an equation $nd=\lambda/2$ causes lights reflected on both interfaces B and C to weaken each other due to the interference.

A first embodiment of a front emission type fluorescent display device according to the present invention will now be described with reference to FIG. 1.

Figure 1:
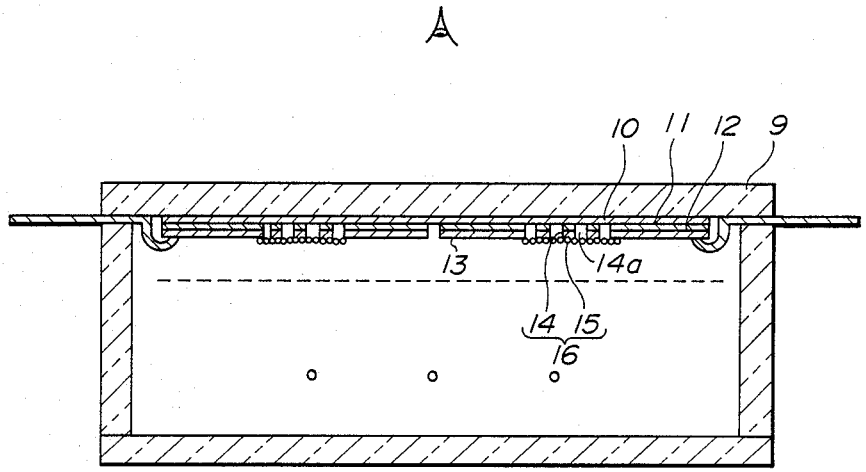
FIG. 1 is a sectional view showing an essential part of a first embodiment of a front emission type fluorescent display device according to the present invention.

In FIG. 1, reference numeral 19 designates a glass substrate, on one surface of which a dielectric layer 10 made of $ZrO_2$ is deposited according to a conventional procedure such as electron beam (EB) vapor deposition, sputtering or the like. On the dielectric layer 10 is deposited an absorption metal layer 11 made of Cr. The deposited dielectric layer 10 and absorption metal layer 11 constitute an antireflection film.

$ZrO_2$ has a refractive index $n_2$ of 2.0 and Cr has a complex refractive index $n_1$ of $2.48+i2.3$. Accordingly, the reflectance R of external ligh at an interface C is represented according to the equation (I), as follows:

$$R = \left| \frac{n_1 - n_2}{n_1 + n_2} \right|^2 = \left| \frac{(2.48 - 2.0) + i2.3}{(2.48 + 2.0) + i2.3} \right|^2 = 0.22$$

The reflectance R of external light at the interface B when $n_3$ of the glass substrate 9 is 1.5 is represented as follows:

$$R = \left| \frac{n_2 - n_3}{n_2 + n_3} \right|^2 = \left| \frac{2.0 - 1.5}{2.0 + 1.5} \right|^2 = 0.02$$

Thus, it will be noted that a sum of the reflectances at the interfaces B and C does not exceed 30%.

A thickness $d_2$ of the dielectric layer 10 is determined to satisfy an equation of $n_2d_2=\lambda/4$, wherein $\lambda$ is a median of wavelength of visible light. Accordingly, in the illustrated embodiment, when $\lambda$ is 500 nm, the thickness $d_2$ of $ZrO_2$ dielectric layer is $$d_2=\lambda/4n_2=500/4\times 2=62.5 \text{ nm.}$$

Actually, it is supposed that the refractive index $n_2$ is somewhat variable depending on conditions for forming the dielectric film and the value of $\lambda$ is in the range of 500–550 nm. Accordingly, in this instance, $d_2$ is determined to be in the range of 62.5–68.0 nm. Thus, lights reflected on the interfaces B and C weaken each other due to the above-described interference therebetween, and the reflectance of external light is further reduced to a level much lower than 30%.

In the illustrated embodiment, a thickness $d_1$ of the absorption metal layer 11 is determined to be in the range between 100 nm and 150 nm. The determination of the thickness within such a range causes a part of external light passing through the interface C to be absorbed in the absorption metal layer 11, and it does not reach the interface D. Even if it reaches the interface D to be reflected thereon, it is further attenuated on a return path. Therefore, the reflection on the interface D does not substantially effect the total reflectance.

The front emission type fluorescent display device of the illustrated embodiment also include a metal film 12 deposited on the absorption metal layer 11 to have a thickness of 1.0–2.0 μm. The metal film 12, as shown in FIG. 1, is subjected to patterning by photolithography to form wiring conductors 13, anode conductors 14 having stripe-like openings 14*a* and the like. The patterning may be carried out by first etching Al and then etching Cr.

The openings 14*a* of the anode conductors 14 each have a

Phosphor layer 15 deposited thereon according to a suitable procedure such as electrode position, printing or the like to form an anode 16 together with the anode conductor 14. Also, a portion of the metal film 12 other than the anodes 16 has a black insulating layer (not shown) deposited thereon to prevent leakage of light therefrom. Above the anode substrate, filamentary cathodes and other electrodes are arranged, and a rear casing is hermetically sealed on one surface of the glass substrate 9 so as to cover the respective electrodes described above as shown for example in commonly assigned U.S. Pat. No. 4,472,658. The casing is evacuated to high vacuum. In this manner, the front emission type fluorescent display device which permits light emitted from the phosphor layers 15 to be observed through the glass substrate 9 and transparent dielectric layer 10 is constructed.

Now, the manner of operation of the front emission type fluorescent display device described above will be described hereinafter.

Figure 4:
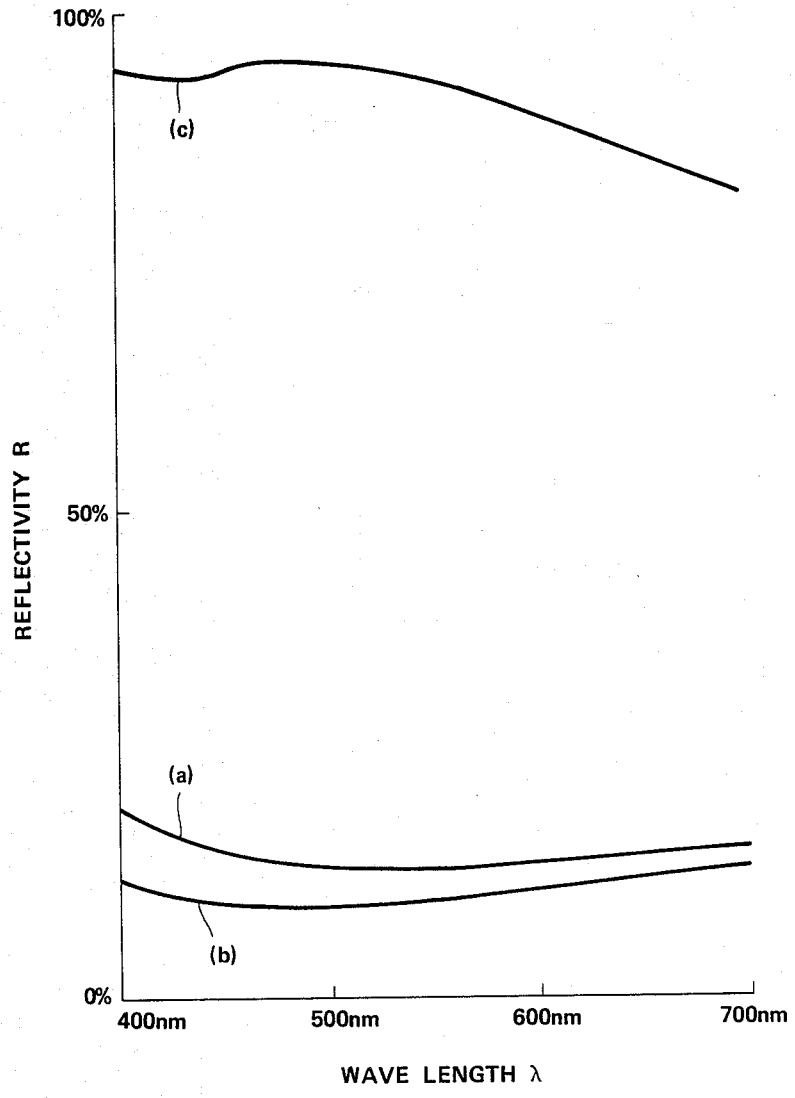
FIG. 4 is a graphical representation showing a reflectance R of visible light of various wavelengthes with respect to an antireflection film.

The curve (a) in FIG. 4 shows an example of reflectance of visible light varied in wavelength in the illustrated embodiment. The curve (c) in FIG. 4 shows reflectance of the visible light in a combination of a glass substrate and an Al film deposited thereon, which was measured for comparison. As is apparent from FIG. 4, in the curve (c), the reflectance R is as large as 95% in the proximity of $\lambda=500$ nm, whereas, in the curve (a) of the illustrated embodiment, the reflectance is decreased to a level as small as about 13%. The curve (a) is not a data which was obtained under the optimum conditions. Accordingly, the present invention is capable of further decreasing the reflectance.

Thus, it will be noted that the front emission type fluorescent display device of the illustrated embodiment is capable of substantially decreasing a reflectance of external ligh at a section other than a display section (background section except a display pattern). Also, in the illustrated embodiment, the anode section is in the form of a strip-like electrode having a numerical aperture of about 90%, and thus a reflectance of external light can be decreased at the anode section as well.

Accordingly, in the present invention, lightening and non-lightening of the display section can be readily distinguished and contrast between the lightened display section and the background can be increased so that the visibility of the display section, particularly, under high illuminance may be highly improved. Accordingly, the fluorescent display device of the present invention is effectively used for a speedometer of a car and the like. Also, $ZrO_2$ used in the embodiment has thermostability sufficient to prevent change in properties during a calcination step in the manufacturing.

Now, a second embodiment of the present invention will be described. The second embodiment is constructed in substantially the same manner as the first embodiment described above except that an absorption metal layer is formed of Mo.

Mo has a complex refractive index of 1.96+i1.0. Accordingly, the use of Mo in combination with $ZrO_2$ of 2.0 in refractive index is considered to render conditions for interference different from the first embodiment. However, as a matter of fact, it is difficult to form a e $ZrO_2$ film and it generally has a refractive index smaller than Mo, and thus the interference conditions in the second embodiment are considered to be substantially the same as the first embodiment.

The curve (b) in FIG. 4 shows an example of a reflectance of external light obtained in the second embodiment and indicates that the second embodiment further decreases the reflectance as compared with the first embodiment.

In each of the first and second embodiments, the refractive index $n_2$ of the dielectric material is smaller than that $n_1$ of the absorption metal. Such a combination includes those described in Table 1.

TABLE 1

| Dielectric Material | Absorption Metal |
|---|---|
| $Al_2O_3$ | Cr, Ge, Mo, Fe, W and the like |
| $ZrO_2$ | Mo, Fe, W and the like |
| $TiO_2$ | Cr, Ge, W and the like |

A combination between the dielectric material and the absorption metal when $n_1<n_2$ includes those described in Table 2. In this instance, interference conditions in these embodiments are considered to be different from the first and second embodiments described above.

TABLE 2

| Dielectric Material | Absorption Metal |
|---|---|
| $TiO_2$ | Mo, Cu, Au, Fe and the like |
| $ZrO_2$ | Cu, Al and the like |

In each of the embodiments described above, the refractive indices of the dielectric layer and absorption metal layer are not necessarily constant and are variable depending on film forming conditions. Accordingly, the adjustment of conditions for obtaining a desired combination of refractive indices expands a range of materials used in combination with each other. $TiO_2$ and $Al_2O_3$ as well as $ZrO_2$ have thermostability sufficient to prevent change in properties during calcination step in the manufacturing of the fluorescent display device, to thereby facilitate the manufacturing.

Further, in each of the above embodiments, the refractive index of the dielectric material is determined to be larger than that (generally 1.5) of the glass substrate. When a material having a refractive index below 1.5 is used for the dielectric layer, any phase inversion does not occur in light reflected on the interface between the glass substrate and the dielectric layer (interface B in FIGS. 1 and 2). Accordingly, the interference conditions are determined in view of this respect.

As can be seen for the foregoing, the front emission type fluorescent display device of the present invention is so constructed that the dielectric layer and absorption metal layer selected to provide a suitable combination in refractive index therebetween are arranged between the glass substrate and the anode conductors to decrease a reflectance of external light at the interface between both layers to a low level and the thickness of the dielectric layer is adjusted to further decrease the reflectance due to the interference between lights reflected.

While preferred embodiments of the invention have been described with a certain degree of particularity, obvious modifications and variations are possible in light of the above teachings. It is therefore to be understood that within the scope of the appended claims, the invention may be practiced otherwise than as a specifically described.

What is claimed as new and desired to be secured by Letters Patent of the United States is:

1. A front emission type fluorescent display device having wiring conductors and light permeable anode conductors, comprising:

a glass substrate;

an antireflection film comprising a dielectric layer deposited on one surface of said glass substrate and a light absorbing absorption metal layer deposited on said dielectric layer;

said wiring conductors and light-permeable anode conductors formed of a metal film deposited on said antireflection film;

said antireflection film provided to prevent external light passing through the glass substrate from being reflected from the wiring conductors and the anode conductors back through the glass substrate;

a phosphor layer deposited on each of said anode conductors, said phosphor layer and anode conductors forming anodes together;

luminous display of said phosphor layer being observed through said glass substrate and anode conductors from the othre side of said glass substrate;

a filamentary cathode arranged above said anodes; and a rear casing hermetically sealed on said one surface of said glass substrate to cover said respective electrodes and evacuated to high vacuum.

2. A front emission type fluorescent display device as defined in claim 1 wherein said dielectric layer of said antireflection layer is formed of a dielectric material of 1.0–3.5 in refractive index.

3. A front emission type fluorescent display device as defined in claim 2, wherein said dielectric material which forms said dielectric layer has a refractive index determined between a refractive index of said glass substrate and a refractive index of said absorption metal layer; and said dielectric layer has a thickness of d which satisfies an equation of $nd=\lambda/4$, wherein n is a refractive index of said dielectric material and $\lambda$ is a median of wavelength of visible light.

4. A front emission type fluorescent display device as defined in claim 2, wherein said dielectric material which forms said dielectric layer has a refractive index determined to be large than a refractive index of said glass substrate and a refractive index of said absorption metal layer; and said dielectric layer has a thickness of d which satisfies an equation of $nd=\lambda/2$, wherein n is a refractive index of said dielectric material and $\lambda$ is a median of wavelength of visible light.

* * * * *